US008522362B1

(12) United States Patent
Stones et al.

(10) Patent No.: US 8,522,362 B1
(45) Date of Patent: Sep. 3, 2013

(54) CLOTHING SYSTEMS

(75) Inventors: Rachel Dawn Stones, Rigby, ID (US); Delorse Kay Raymond, Rigby, ID (US)

(73) Assignee: Rachel Dawn Stones, Rigby, ID (US)

( * ) Notice: Subject to any disclaimer, the term of this patent is extended or adjusted under 35 U.S.C. 154(b) by 104 days.

(21) Appl. No.: 13/027,108

(22) Filed: Feb. 14, 2011

Related U.S. Application Data

(60) Provisional application No. 61/305,777, filed on Feb. 18, 2010.

(51) Int. Cl.
*A41D 5/00* (2006.01)

(52) U.S. Cl.
USPC ..... 2/67; 450/33

(58) Field of Classification Search
USPC ..... 2/67, 69–72, 82; 450/3–6, 30, 33
See application file for complete search history.

(56) References Cited

U.S. PATENT DOCUMENTS

| | | | | |
|---|---|---|---|---|
| 3,106,717 | A * | 10/1963 | Cuvin | 2/70 |
| 4,656,669 | A | 4/1987 | Beard | |
| 4,815,145 | A | 3/1989 | Chow | |
| 6,016,569 | A | 1/2000 | Everett et al. | |
| 6,035,439 | A | 3/2000 | Chin | |
| 6,185,741 | B1 | 2/2001 | Kehoe | |
| 6,240,560 | B1 * | 6/2001 | DeCaro | 2/67 |
| 8,051,496 | B2 * | 11/2011 | Hersh | 2/67 |
| 2009/0126072 | A1 * | 5/2009 | Allen | 2/82 |

* cited by examiner

*Primary Examiner* — Katherine Moran
(74) *Attorney, Agent, or Firm* — Workman Nydegger

(57) ABSTRACT

A clothing system may include a first two-piece swimsuit. The first two-piece swimsuit may include a swimsuit top and a swimsuit bottom. The clothing system may include further include a midsection cover sized and configured to be selectively connected to the swimsuit top to form a second two-piece swimsuit.

4 Claims, 2 Drawing Sheets

CLOTHING SYSTEMS

CROSS-REFERENCE TO RELATED APPLICATIONS

This application claims priority to, and the benefit of, U.S. provisional patent application Ser. No. 61/305,777, filed Feb. 18, 2010 and entitled CLOTHING SYSTEMS AND METHODS, which is incorporated by reference in its entirety.

BACKGROUND

1. Field of the Invention

The present invention generally relates to clothing.

2. Background Technology

Women often wear maternity clothing during their pregnancies. Unfortunately, maternity clothing can be very expensive and is typically worn for only a few short months. Moreover, saving and reusing the maternity clothing to help spread the maternity clothing's cost over multiple pregnancies is typically not a good option given that the maternity clothing may be outdated at the time of the subsequent pregnancies.

In addition, women often buy multiple swimsuits. Unfortunately, this can be expensive.

SUMMARY

One aspect is a clothing system that may include a first two-piece swimsuit. The first two-piece swimsuit may include a swimsuit top and a swimsuit bottom. The swimsuit top may include at least one fastener member. The clothing system may further include a midsection cover sized and configured to be selectively connected to the swimsuit top to form a second two-piece swimsuit. For example, the first two-piece swimsuit may be a bikini, and the second two-piece swimsuit may be a tankini. The midsection cover may include an upper edge and a lower edge. The upper edge may include at least one engaging portion sized and configured to engage the at least one engaging portion of the swimsuit top. The lower edge may be configured to be connected to the swimsuit bottom, such that the midsection cover, when connected to the swimsuit top, is positionable independent from the swimsuit bottom.

A further aspect is a plurality of midsection covers that may be sized and configured to be selectively connected to the swimsuit top to form a variety of two-piece swimsuits. For instance, a woman may connect a first midsection cover to the swimsuit top to form a first tankini swimsuit that she may wear when she is not pregnant and/or during the first months of her pregnancy. The woman may later disconnect the first midsection cover from the swimsuit top and then connect a second midsection cover to the swimsuit top to form a second tankini swimsuit, which she may wear during her latter months of her pregnancy and/or during her recovery from pregnancy. To better accommodate the woman's pregnant belly, the second midsection cover may have a larger circumference and/or length, and/or may flair outwardly more than the first midsection cover.

A still further aspect is the swimsuit top may include at least one snap member with a lip or groove, and an upper edge or portion of a midsection cover may include at least one snap member with a lip or groove sized and configured to engage the lip or groove of the swimsuit top's snap member. For example, the swimsuit top may include a plurality of snap members that may be secured to an elastic and/or expandable lower portion of the swimsuit top. In particular, the swimsuit top may include a lower portion made from an elastic and/or expandable material, and the snap members may be independently secured to the swimsuit top's lower portion. Desirably, if some or all of the snap members are independently secured to an elastic and/or expandable material lower portion of the swimsuit top, this may allow the snap members to be connected to a plurality of different-sized midsection covers.

For purposes of summarizing, some aspects, advantages and features of a few of the embodiments of the invention have been described in this summary. Some embodiments of the invention may include some or all of these summarized aspects, advantages and features. However, not necessarily all of (or any of) these summarized aspects, advantages or features will be embodied in any particular embodiment of the invention. Thus, none of these summarized aspects, advantages and features are essential. Some of these summarized aspects, advantages and features and other aspects, advantages and features may become more fully apparent from the following detailed description and the appended claims.

BRIEF DESCRIPTION OF THE DRAWINGS

The appended drawings contain figures of preferred embodiments to further clarify the above and other aspects, advantages and features. It will be appreciated that these drawings depict only preferred embodiments of the invention and are not intended to limit its scope. These preferred embodiments will be described and explained with additional specificity and detail through the use of the accompanying drawings in which.

DETAILED DESCRIPTION

As shown in the accompanying figures, a clothing system may include one or more components of an article of clothing, for example, a swimsuit or other suitable article of clothing. These components may be interconnected in a variety of different combinations to allow the article of clothing to have various styles or designs, configurations and/or functionality.

Figure 1:
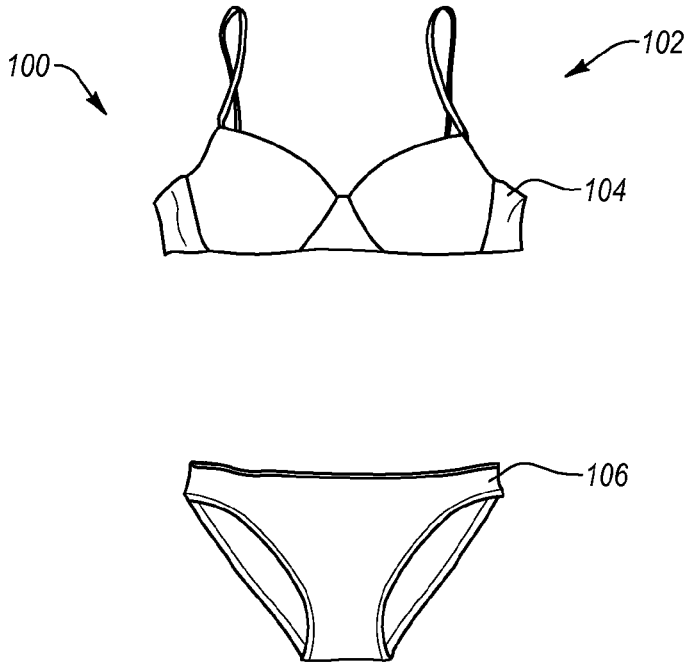
FIG. 1 is a perspective view of an exemplary clothing system, illustrating a first two-piece swimsuit including a swimsuit top and a swimsuit bottom.

As shown in FIG. 1, a clothing system 100 may include a first component and one or more additional components that may be sized and configured to be selectively connected to and disconnected from the first component. Significantly, the additional components may be sized and configured to be interchangeably connected to and disconnected from the first component, if desired.

In further detail, as shown in FIG. 1, the clothing system 100 may include a swimsuit, such as a bikini 102 that may include a top 104 and a bottom 106. The swimsuit top 104 is configured to cover a wearer's breasts. The swimsuit bottom 106 is configured to cover the wearer's groin and buttocks.

Figure 2:
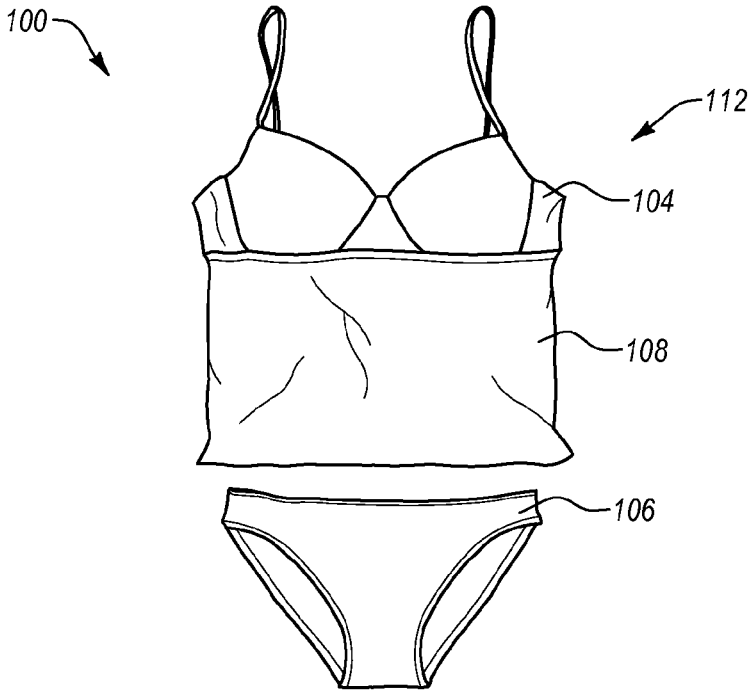
FIG. 2 is a perspective view of the clothing system shown in FIG. 1, illustrating another two-piece swimsuit including the swimsuit top, the swimsuit bottom and a midsection cover.
Figure 3:
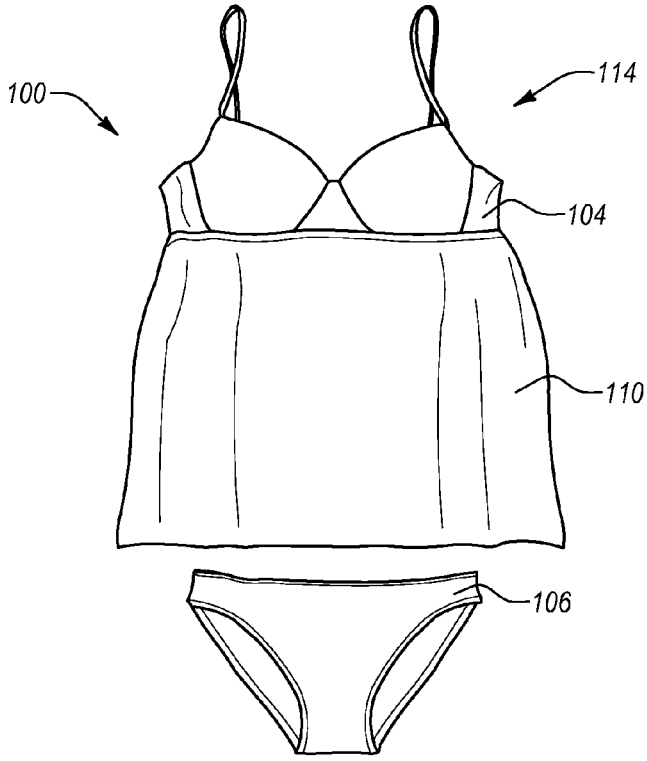
FIG. 3 is a perspective view of the clothing system shown in FIG. 1, illustrating yet another two-piece swimsuit including the swimsuit top, the swimsuit bottom and another midsection cover.

As shown in FIGS. 2-3, the clothing system 100 may further include one or more covers 108, 110 configured to cover and encircle the wearer's midsection. The midsection covers 108, 110 are sized and configured to be selectively connected to and disconnected from the swimsuit top 104. Thus, the midsection covers 108, 110 may be interchangeably connected to and disconnected from the swimsuit top 104.

The swimsuit top 104 may be connected to a variety of midsection covers. For example, the midsection cover 108 may have a first, relatively smaller circumference and/or length. Accordingly, a woman may connect the midsection cover 108 to the swimsuit top 104, as shown in FIG. 2, to form a first tankini swimsuit 112 that she may wear when she is not pregnant and/or during the first months of her pregnancy. The woman may later disconnect the midsection cover 108 from the swimsuit top 104 and then connect the midsection cover 110 to the swimsuit top 104 to form a second tankini swimsuit 114 shown in FIG. 3, which she may wear during her latter months of her pregnancy and/or during her recovery from pregnancy.

To better accommodate the wearer's pregnant belly, the midsection cover 110 may have a second, relatively larger circumference and/or length. For example, the length and/or circumference of the midsection cover 110 may be at least five percent, ten percent, fifteen percent, twenty percent, thirty percent, forty percent, fifty percent, sixty percent and/or seventy percent greater than the length and/or circumference of the midsection cover 108.

In addition, to better accommodate the wearer's pregnant belly, the midsection cover 110 may flair outwardly more than the midsection cover 108. For example, the midsection cover 110 may flair outwardly at an angle that is at least five degrees, ten degrees, fifteen degrees, twenty degrees, twenty-five degrees, thirty degrees, forty degrees, fifty degrees or more from the orientation of the midsection cover 108.

After her pregnancy and/or her recovery, the woman may disconnect the midsection cover 110 from the swimsuit top 104. If desired, the woman may then choose not to use any midsection cover 108, 110 and thus wear the bikini 102 shown in FIG. 1. Alternatively, the woman may choose to connect the midsection cover 108 to the swimsuit top 104 to form the tankini swimsuit 112 shown in FIG. 2. Of course, the woman need not disconnect the midsection cover 110 from the swimsuit top 104 after her pregnancy and/or her recovery and may choose to continue to wear the tankini swimsuit 114 shown in FIG. 3. Thus, by using various midsection covers (or none at all), the clothing system 100 may be used before, during and/or after pregnancy, which may help avoid some of the costs associated with swimsuits generally and maternity swimsuits in particular.

An upper edge or portion of the midsection covers 108, 110 may be sized and configured to be selectively and/or interchangeably connected to and disconnected from the swimsuit top 104. For example, the upper edge of the midsection covers 108, 110 may, for example, include attachment portions that may be sized and configured to be selectively and/or interchangeably connected to and disconnected from an attachment portion of the swimsuit top 104, and the attachment portions of the swimsuit top and midsection covers may include at least a portion of one or more zippers, buttons, snaps, hooks, hook-and-loop fasteners (e.g., Velcro) and/or any other suitable means for connecting the swimsuit top and upper components.

In further detail, the swimsuit top 104 may include one or more fastener members, and the upper edge or portion of the midsection covers 108, 110 may include one or more fastener members sized and configured to be selectively and/or interchangeably connected to and disconnected from the swimsuit top's one or more fastener members. Exemplary fastener members may include, but are not limited to, zipper teeth of a zipper, snap members of a snap fastener, a hooked or looped portion of a hook-and-loop fastener, and other fastener members of other fasteners.

To help selectively and/or interchangeably connect and disconnect the fastener members, the fastener members of the swimsuit top 104 and the midsection covers 108, 110 may include one or more engaging portions that may be sized and configured to engage each other. For example, the swimsuit top 104 may include zipper teeth, and an upper edge or portion of a midsection cover 108, 110 may include zipper teeth having portions sized and configured to engage portions of the swimsuit top's zipper teeth.

Also, for example, the swimsuit top 104 may include a hooked or looped portion of a hook-and-loop fastener, and an upper edge or portion of a midsection cover 108, 110 may include a hooked or looped portion of a hook-and-loop fastener that is sized and configured to engage the swimsuit top's hooked or looped portion.

Figure 4:
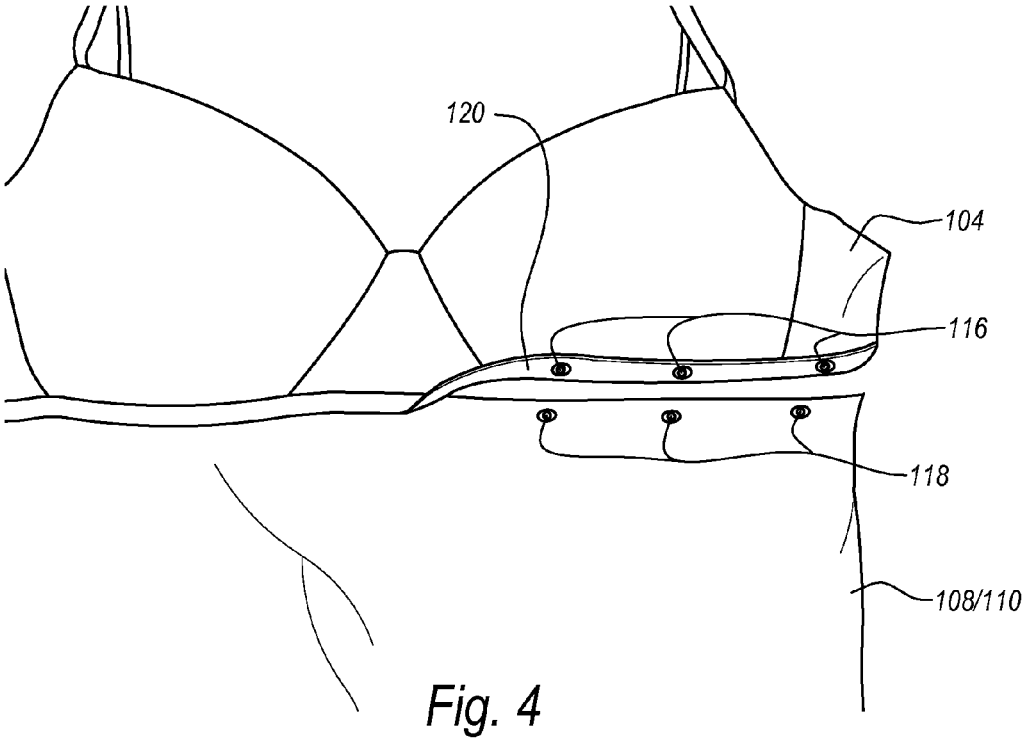
FIG. 4 is a perspective view of a portion of the clothing system shown in FIGS. 2 and 3, illustrating exemplary fastener members that may be used to connect the midsection covers to the swimsuit top.

Moreover, for example, as shown in FIG. 4, the swimsuit top 104 may include at least one snap member 116 with a lip or groove, and an upper edge or portion of a midsection cover 108, 110 may include at least one snap member 118 with a lip or groove sized and configured to engage the lip or groove of the swimsuit top's snap member. As shown in FIG. 4, the swimsuit top 104 may include a plurality of snap members 116 that may be secured to an elastic and/or expandable lower portion 120 of the swimsuit top. In particular, the swimsuit top 104 may include a lower portion made from an elastic and/or expandable material, and the snap members 116 may be independently secured to the swimsuit top's lower portion.

Desirably, if some or all of the snap members 116 are independently secured to an elastic and/or expandable material lower portion of the swimsuit top 104 (instead of forming part of a single, fixed-length tape of snap members that are sewn to the swimsuit top's lower portion), this may provide a more comfortable swimsuit top 104. In addition, if some or all of the snap members 116 are independently secured to an elastic and/or expandable material lower portion of the swimsuit top 104, this may allow the snap members 116 to be connected to the snap members 118 of both midsection covers 108, 110. For instance, because the midsection covers 108, 110 could have substantially different circumferences and also could include the same number of snap members, the average distance between adjacent snap members 118 in the midsection cover 110 may be at least five percent, ten percent, fifteen percent, twenty percent, thirty percent, forty percent, fifty percent, sixty percent and/or seventy percent greater than the average distance between adjacent snap members 118 in the midsection cover 108. Desirably, if some or all of the snap members 116 are independently secured to an elastic and/or expandable lower portion of the swimsuit top, this may allow the distance between adjacent snap members 116 to vary when the lower portion is stretched/expanded. This may help the average distance of the snap members 116 to be increased or decreased for connection to the snap members 118 of the midsection covers 108, 110. If desired, however, the average distance between adjacent snap members 118 in the midsection cover 108 may be similar to, or the same as, the average distance between adjacent snap members 118 in the midsection cover 110. Moreover, if desired, the average distance between adjacent snap members 116 of the swimsuit top 104 may be similar to, or the same as, the average distance between adjacent snap members 118 in the midsection cover 108 and/or the average distance between adjacent snap members 118 in the midsection cover 110.

In some embodiments, when a midsection cover 108, 110 is connected to the swimsuit top 104, the top and midsection cover's line of connection may be at least partially hidden and/or may form part of a design element of the article of clothing. For example, one or more seams sewn into the swimsuit top 104 and/or the midsection cover 108, 110 may be disposed proximate to and/or may cover all or at least a substantial portion of the top and midsection cover's line of connection. Also, flaps or other structures may be disposed proximate to and/or may cover all or at least a substantial portion of the top and midsection cover's line of connection.

In further detail, the swimsuit top 104 and an upper edge of a midsection cover 108, 110 may—when the top and midsection cover are connected—at least partially abut and/or overlap to cover all or at least a substantial portion of their line of connection. For example, when the swimsuit top 104 and the upper edge of the midsection cover 108, 110 include zipper teeth that engage each other, the top and the upper edge of the midsection cover may at least partially abut and/or overlap to cover all or at least a substantial portion of their engaged zipper teeth. In addition, the top 104 and the upper edge of the midsection cover 108, 110 may have a seam finish, for instance, when the top and the upper edge of the midsection cover form part of an "open-end invisible zipper" type of zipper (also known as an "invisible separating zipper"). It will be appreciated, however, that the zipper teeth and/or line of connection of the swimsuit top 104 and the midsection cover 108, 110 need not be hidden at all. It will also be appreciated that an open-end invisible zipper is not required and that other types of zippers and/or fasteners may be used to selectively and/or interchangeably connect the top 104 and the upper edge of the midsection cover 108, 110.

Although the upper edge or portion of the midsection covers 108, 110 may be sized and configured to be connected to the swimsuit top 104, the lower edges or portions of the midsection covers 108, 110 are preferably not configured to be connected to the swimsuit bottom 106. For example, in some embodiments, the lower edges or portions of the midsection covers 108, 110 have no fastener members configured to be used to be connected to the swimsuit bottom 106. Desirably, if the lower edges or portions of the midsection covers 108, 110 are not configured to be connected to the swimsuit bottom 106, the midsection covers 108, 110 may be used to form a two-piece swimsuit—such as the tankini swimsuits 112, 114 in FIGS. 2 and 3. In addition, if the lower edges or portions of the midsection covers 108, 110 are not configured to be connected to the swimsuit bottom 106, the midsection covers may be sized and configured to be positioned independent from any position of the swimsuit bottom.

Thus, as shown above, the swimsuit top 104, the swimsuit bottom 106, and the midsection covers 108, 110 may be used to create a plurality of two-piece swimsuits, in particular, a bikini 102 shown in FIG. 1, a first tankini 112 shown in FIG. 2 and a second tankini 114 shown in FIG. 3. Desirably, this may provide a wearer with a more versatile swimwear wardrobe that may be used before, during and/or after pregnancy, which may help avoid some of the costs associated with swimsuits generally and maternity swimsuits in particular.

After pregnancy, a swimsuit, such as a tankini swimsuit or a one-piece swimsuit, may help facilitate breastfeeding. For example, as noted above, a midsection cover 108, 110 may be connected to the swimsuit top 104 to form the tankini 112, 114. If desired, the midsection cover 108, 110 may be partially disconnected from the swimsuit top 104 to form an access opening through which a baby may be breastfed. To form this access opening, at least some of the fastener members of the swimsuit top 104 are disengaged from corresponding fastener members of the midsection cover 108, 110, while at least some of the fastener members of the swimsuit top 104 remain engaged with corresponding fastener members of the midsection cover 108, 110. This may advantageously allow a woman to easily, yet discreetly, breastfeed her baby while wearing the swimsuit. If desired, to form a one-piece swimsuit that facilitates breastfeeding, the midsection cover 108, 110 could be connected to the swimsuit bottom 106 using, for example, one or more fastener members.

The methods and systems described above require no particular component or function. Thus, any described component or function—despite its advantages—is optional. For example, it will be appreciated that an article of clothing does not require any expandable maternity waistband or any other kind of waistband or expandable portion. It will be further appreciated that the article of clothing needs not be an article of maternity clothing and may be any other suitable type of clothing. Also, some or all of the described components and functions described above may be used in connection with any number of other suitable components and functions.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A clothing system comprising:

a first, bikini swimsuit including:

a swimsuit top including:

an upper portion;

a lower portion constructed from an elastic, expandable material; and a plurality of snap members independently secured to the elastic, expandable lower portion of the swimsuit top; and a swimsuit bottom;

a first midsection cover sized and configured to be selectively connected to the swimsuit top, but not connected to the swimsuit bottom, to form a first tankini swimsuit, the first midsection cover including:

an upper edge;

a plurality of snap members secured to the upper edge of the first midsection cover and sized and configured to be connected to the plurality of snap members secured to the elastic, expandable lower portion of the swimsuit top; and a lower edge that is not configured to be connected to the swimsuit bottom, such that the first midsection cover, when connected to the swimsuit top, is positionable independent from the swimsuit bottom; and a second midsection cover sized and configured to be selectively connected to the swimsuit top, but not connected to the swimsuit bottom, to form a second tankini swimsuit, the second midsection cover including:

an upper edge;

a plurality of snap members secured to the upper edge of the second midsection cover and sized and configured to be connected to the plurality of snap members secured to the elastic, expandable lower portion of the swimsuit top; and a lower edge that is not configured to be connected to the swimsuit bottom, such that the second midsection cover, when connected to the swimsuit top, is positionable independent from the swimsuit bottom;

wherein the snap members of the first midsection are separated by a first average distance;

wherein the snap members of the second midsection are separated by a second average distance that is greater than the first average distance that separates the snap members of the first midsection; and wherein the swimsuit top's lower portion is configured to elastically expand and contract to allow the plurality of snap members secured to the swimsuit top's lower portion to be interchangeably connected to the plurality of snap members of the first midsection and the plurality of snap members of the second midsection.

2. The clothing system as in claim 1, wherein the snap members of the second midsection are separated by a second average distance that is at least ten percent greater than the first average distance that separates the snap members of the first midsection.

3. The clothing system as in claim 1, wherein the snap members of the second midsection are separated by a second average distance that is at least twenty percent greater than the first average distance that separates the snap members of the first midsection.

4. The clothing system as in claim 1, wherein the snap members of the second midsection are separated by a second average distance that is at least thirty percent greater than the first average distance that separates the snap members of the first midsection.

* * * * *